US006651758B2

(12) United States Patent
Xiang et al.

(10) Patent No.: US 6,651,758 B2
(45) Date of Patent: Nov. 25, 2003

(54) ROLLING CONE BIT WITH ELEMENTS FANNED ALONG THE GAGE CURVE

(75) Inventors: Ying Xiang, The Woodlands, TX (US); James Carl Minikus, Spring, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/860,936

(22) Filed: May 18, 2001

(65) Prior Publication Data

US 2002/0017401 A1 Feb. 14, 2002

Related U.S. Application Data

(60) Provisional application No. 60/205,367, filed on May 18, 2000.

(51) Int. Cl.[7] ..... E21B 10/08; E21B 10/16

(52) U.S. Cl. ..... 175/431; 175/341; 175/378

(58) Field of Search ..... 175/327, 331, 175/336, 341, 374, 377, 338, 406, 400, 426, 431

(56) References Cited

U.S. PATENT DOCUMENTS

| | | | | | |
|---|---|---|---|---|---|
| 3,452,831 | A | | 7/1969 | Beyer | 175/374 |
| 4,056,153 | A | * | 11/1977 | Miglierini | 175/374 |
| 4,058,177 | A | * | 11/1977 | Langford et al. | 175/374 |
| 4,187,922 | A | * | 2/1980 | Phelps | 175/374 |
| 4,203,496 | A | * | 5/1980 | Baker et al. | 175/343 |
| 4,343,372 | A | * | 8/1982 | Kinzer | 175/374 |
| 4,427,081 | A | | 1/1984 | Crawford | 175/376 |
| 5,131,480 | A | * | 7/1992 | Lockstedt et al. | 175/374 |
| 5,145,016 | A | * | 9/1992 | Estes | 175/331 |
| 5,201,376 | A | * | 4/1993 | Williams | 175/374 |

FOREIGN PATENT DOCUMENTS

| | | | | |
|---|---|---|---|---|
| EP | 0511547 A2 | * | 11/1992 | E21B/10/16 |
| EP | 0593268 A2 | | 4/1994 | E21B/10/16 |
| EP | 01789130 A2 | | 8/1997 | E21B/10/16 |
| GB | 2319549 A | | 10/1997 | E21B/10/16 |
| GB | 2324555 A | | 10/1998 | E21B/10/16 |

OTHER PUBLICATIONS

Search Report for British application No. 0112183.9 dated Sep. 25, 2001.

(List continued on next page.)

*Primary Examiner*—David Bagnell
*Assistant Examiner*—Jennifer H Gay
(74) *Attorney, Agent, or Firm*—Conely Rose, P.C.

(57) ABSTRACT

An earth-boring bit for drilling a borehole comprises a bit body having a bit axis, at least two rolling cone cutters rotatably mounted on the bit body, a plurality of inner row cutter elements positioned on at least one cone cutter in a first inner row, a plurality of gage-cutting cutter elements positioned in a first fanned-gage row on a first one of the one cutters, and a plurality of gage-cutting cutter elements positioned in a second fanned-gage row on a second one of the one cutters, wherein the gage-cutting cutter elements on the bit define a gage curve and cutter elements in the first fanned-gage row and the second fanned-gage row contact the gage curve at different points. In one embodiment, each cutter element has an extension, and the extensions of the uppermost fanned-gage row cutter element and the first inner row cutter element define a step distance such that the ratio of the step distance to the extension of the first inner row cutter element is greater than 0.5. Alternatively, the first and second fanned-gage rows are positioned to have different oversize angles, positioned such that the ratio of the diameter of the largest fanned-gage row cutter element to the diameter of the first inner row cutter elements is not greater than 0.75, or positioned such that the lowermost fanned-gage row contains more cutter elements than any other fanned-gage row.

47 Claims, 4 Drawing Sheets

U.S. PATENT DOCUMENTS

| | | | | | |
|---|---|---|---|---|---|
| 5,353,885 | A | * | 10/1994 | Hooper et al. | 175/374 |
| 5,372,210 | A | | 12/1994 | Harrell | 175/431 |
| 5,542,485 | A | * | 8/1996 | Pessier et al. | 175/371 |
| 5,671,817 | A | | 9/1997 | Smith et al. | 175/374 |
| 5,695,018 | A | * | 12/1997 | Pessier et al. | 175/331 |
| 5,833,020 | A | | 11/1998 | Portwood et al. | 175/331 |
| 5,839,526 | A | | 11/1998 | Cisneros et al. | 175/431 |
| 5,967,245 | A | | 10/1999 | Garcia et al. | 175/374 |
| 6,176,329 | B1 | | 1/2001 | Portwood et al. | 175/341 |
| 6,390,210 | B1 | * | 5/2002 | Portwood et al. | 175/331 |
| 2002/0079138 | A1 | * | 6/2002 | Xiang | 175/331 |

* cited by examiner

ROLLING CONE BIT WITH ELEMENTS FANNED ALONG THE GAGE CURVE

CROSS-REFERENCE TO RELATED APPLICATIONS

The present application claims the benefit under 35 U.S.C. §111 of provisional application Ser. No. 60/205,367, filed May 18, 2000, and entitled "Rolling Cone Bit with Elements Fanned Along the Gage Curve," which is incorporated herein by reference.

FIELD OF THE INVENTION

The invention relates generally to earth-boring bits used to drill a borehole for the ultimate recovery of oil, gas or minerals. More particularly, the invention relates to rolling cone bits and to an enhanced cutting structure for such bits. Still more particularly, the invention relates to the placement of gage cutter elements on the rolling cone cutters at locations that increase bit durability and rate of penetration.

BACKGROUND OF THE INVENTION

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to drill a borehole along a predetermined path toward a target zone. The borehole formed in the drilling process will have a diameter generally equal to the diameter or "gage" of the drill bit. As used herein, "bit diameter" and "gage diameter" refer to the same parameter.

A typical earth-boring bit includes one or more rotatable cutters that perform their cutting function due to the rolling movement of the cutters acting against the formation material. The cutters roll and slide on the bottom of the borehole as the bit is rotated, with the cutters engaging and disintegrating the formation material in the path of the bit. The rotatable cutters may be described as generally conical in shape and are therefore sometimes referred to as rolling cones. Rolling cone bits typically include a bit body with a plurality of journal segment legs. The rolling cones are mounted on bearing pin shafts that extend downwardly and inwardly from the journal segment legs. Each cone includes a plurality of cutter elements in its outer conical surface. The borehole is formed as the gouging and scraping or crushing and chipping action of the rotary cones remove chips of formation material. The chips are carried upward and out of the borehole by a drilling fluid, which is pumped downwardly through the drill pipe and out of the bit, and recirculates to the surface via the annulus between the drill pipe and the borehole wall.

The earth disintegrating action of the rolling cone cutters is enhanced by the cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are known as "steel tooth bits." In each case, the cutter elements on the rotating cutters functionally breakup the formation to form new borehole by a combination of gouging and scraping or chipping and crushing.

The cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits that will drill faster and longer and that are usable over a wider range of formation hardness.

The length of time that a drill bit may be employed before it must be changed depends upon its rate of penetration ("ROP"), as well as its durability or ability to maintain an acceptable ROP. The form and positioning of the cutter elements upon the cutters greatly impact bit durability and ROP and thus are critical to the success of a particular bit design.

Bit durability is, in part, measured by a bit's ability to "hold gage," meaning its ability to maintain a full gage borehole diameter over the entire length of the borehole. Gage-holding ability is particularly vital in directional drilling applications, which have become increasingly important. If gage is not maintained relatively constant, it becomes more difficult, and thus more costly, to insert drilling apparatus into the borehole than if the borehole had a constant diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain fall gage. This unnecessary wear will shorten the bit life of the newly-inserted bit, thus prematurely requiring the time consuming and expensive process of removing the drill string, replacing the worn bit, and reinstalling another new bit downhole.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutter elements on the bit, and may accelerate wear of the cutter bearing and ultimately lead to bit failure.

In addition to the heel row inserts, conventional bits typically include a gage row of cutter elements mounted adjacent to the heel surface but oriented and sized in such a manner so as to cut the corner of the borehole. In this orientation, the gage cutter elements generally are required to cut both the borehole bottom and sidewall. The lower surface of the gage row insert engages the borehole bottom while the radially outermost surface scrapes the sidewall of the borehole. Conventional bits also include a number of additional rows of cutter elements that are located on the cones in rows that are disposed radially inward from the gage row. These cutter elements are sized and configured for cutting the bottom of the borehole and are typically described as inner row cutter elements.

In general, the cutting action of the cutter elements at the borehole bottom is typically a crushing or gouging action, while the cutting action at the sidewall is a scraping or reaming action. Because differing forces are applied to the cutter elements by the sidewall than the borehole bottom, it is desired to separate these cutting duties so that the corresponding cutter elements can be optimized.

One U.S. Patent that teaches the separation of sidewall and bottom cutting duties is U.S. Pat. No. 5,372,210. U.S. Pat. No. 5,372,210 teaches the benefits of distributing the inserts on each rolling cone such that a more rounded borehole corner is formed. The '210 patent provides a "transition row" of cutter elements, which drill the rounded corner between the vertical sidewall and the borehole bottom. The purpose of this configuration is to reduce concentrated side forces and to facilitate directional drilling while minimizing gage wear. The '210 patent further provides an arrangement whereby the gage row insert diameter on each rolling cone is different than the others. Additionally, the '210 patent stresses the importance of providing each rolling cone with a gage row that acts upon the same portion of the borehole sidewall, redundantly. According to the '210 patent, a bit having a cone with a gage row that is placed to cut a portion of the borehole sidewall closer to or farther from the borehole bottom than the gage rows on the other cone(s) will experience a force imbalance that can cause bit gyration, bit whirl, or off-center rotation.

Another patent, U.S. Pat. No. 3,452,831, teaches a rolling cone for use in a bit, wherein the rolling cone supports multiple circumferential rows of cutter inserts that all serve to ream to the borehole sidewall to the same diameter. The '831 patent teaches that the reaming or heel row cutters are redundant with the corner cutting inserts. Various other configurations for accomplishing the desired drilling efficiency, ROP and bit life are disclosed in the art.

Nevertheless, it has been discovered that, in an effort to maintain a full gage borehole, the conventional (prior art) arrangement of cutting elements on a bit provides an overpopulation of cutter elements responsible for cutting the borehole corner. This overpopulation of cutter elements, though effective for maintaining a full gage borehole, corresponds to inadequate forces acting on the borehole bottom portion of the corner as well as ineffective usage of the cutter elements in the inner rows, thus resulting in reduced bottom hole cutting efficiency. Hence, there remains a need for a bit that is optimized for certain types of formations where powerful bottom hole cutting ability is crucial.

Accordingly, there remains a need in the art for a drill bit and cutting structure that are more durable than those conventionally known and that will yield greater ROP's and increase the footage drilled while maintaining a full gage borehole. Preferably, the bit and cutting structure provide these advantages without requiring the compromises in cutter element toughness, wear resistance or hardness that are common in conventional bits.

SUMMARY OF THE INVENTION

The present invention provides an earth boring bit for drilling a borehole of a predetermined gage. In many formation types, the bit provides increased durability, ROP and footage drilled at full gage as compared with similar bits of conventional technology. The bit includes a bit body and one or more rolling cone cutters rotatably mounted on the bit body. Each rolling cone cutter includes a generally conical surface, an adjacent heel surface, and preferably a circumferential shoulder therebetween. A row of heel cutter elements are secured to the cone cutter and have cutting surfaces aligned with the gage curve, as is known in the art. At least one row of fanned-gage cutter elements are secured to the cone cutter and have cutting surfaces that cut to full gage. The cutter elements in the fanned-gage rows are fanned out or strategically positioned at various locations along the borehole sidewall such that the amount of borehole bottom cutting responsibility of each fanned gage row is progressively reduced as its sidewall contact point is positioned farther from the hole bottom. The bit further includes a plurality of inner row cutter elements that are secured to the cone cutter on the conical surface. The placement of the gage rows in the fanned configuration serves to transfer a greater amount of cutting force to the adjacent inner rows, thereby increasing the cutting efficiency of the inner rows.

According to the invention, the cutter elements may be hard metal inserts having cutting portions attached to generally cylindrical base portions that are mounted in the cone cutter, or may comprise steel teeth that are milled, cast, or otherwise integrally formed from the cone material. The orientation, mounting angle, diameter, extension and shape of cutter elements in the fanned-gage rows may be the same for all the cone cutters on the bit, or may vary between the cone cutters in order to achieve a desired balance of durability and wear characteristics for the cone cutters. The fanned-gage row cutter elements may be mounted along or near the circumferential shoulder, either on the heel surface or on the adjacent conical surface.

Where the fanned-gage cutter elements and first inner row cutter elements are inserts, the ratio of the diameter of at least one of the fanned-gage row inserts to the diameter of the inner row inserts is preferably not greater than 0.75 for certain preferred embodiments of the invention.

In another embodiment, on the cone containing the first inner row, the extensions of the fanned-gage row cutter element and the first inner row cutter element define a step distance, where the ratio of the step distance to the extension of the first inner row cutter element is greater than 0.5.

In another preferred embodiment, the fanned-gage row cutter element of each cone defines an oversize angle, wherein the difference between the oversize angles of any two cones is at least 0.5 degrees.

In another preferred embodiment, a bit in accordance with the invention comprises a bit body having a bit axis, at least two and more preferably at least three rolling cone cutters rotatably mounted on said bit body and having a generally conical surface and an adjacent heel surface, a plurality of inner row cutter elements positioned on at least one cone cutter in a first inner row, a plurality of gage-cutting cutter elements positioned in a first fanned-gage row on a first one of said one cutters, a plurality of gage-cutting cutter elements preferably positioned in a second fanned-gage row on a second one of said one cutters, and a plurality of gage-cutting cutter elements positioned in a third fanned-gage row on a third one of said one cutters, wherein the cutter elements in said first fanned-gage row, said second fanned-gage row, and said third fanned-gage row contact the gage curve at different points.

In another embodiment, the first and second fanned-gage rows of gage-cutting cutter elements are positioned to contact the gage curve at least two different points, each cutter element has an extension, and the extensions of the uppermost fanned-gage row cutter element and the first inner row cutter element define a step distance, and wherein the ratio of the step distance to the extension of the first inner row cutter element is greater than 0.5.

In another embodiment, the first and second fanned-gage rows of gage-cutting cutter elements are positioned to contact the gage curve at least two different points, each cutter element has an extension, and the fanned-gage rows are positioned such that the cone cutters have different oversize angles.

In another embodiment, the first and second fanned-gage rows of gage-cutting cutter elements are positioned to contact the gage curve at least two different points, each cutter element has an extension, and the ratio of the diameter of the largest fanned-gage row cutter element to the diameter of the first inner row cutter elements is preferably not greater than 0.75.

In another embodiment, the first and second fanned-gage rows of gage-cutting cutter elements are positioned to contact the gage curve at least two different points, each cutter element has an extension, and the lowermost fanned-gage row contains more cutter elements than any other fanned-gage row.

In another embodiment, the first and second fanned-gage rows of gage-cutting cutter elements are positioned on lands on cone cutters and contact a gage curve at least two different points.

In another embodiment, the bit further includes a plurality of heel-cutting cutter elements positioned on at least two cone cutters on lands.

In another embodiment, the first, second, and third fanned-gage rows of gage-cutting cutter elements are positioned to contact a gage curve at different points and the calculated scraping distances are different with the same given cone to bit speed ratio for said gage-cutter cutting elements.

In another embodiment, the first, second, and third fanned-gage rows of gage-cutting cutter elements are positioned to contact a gage curve at different points, wherein the lower-most fanned-gage row is positioned on the same cone cutter as the third inner row cutting elements.

In another embodiment, the first and second fanned-gage rows of gage-cutting cutter elements are positioned to contact a gage curve at different points, wherein the first and second inner rows extend further than the fanned-gage rows.

In another embodiment, the first and second fanned-gage rows of gage-cutting cutter elements are positioned to contact a gage curve at different points, wherein the vertical force exerted on the first and second fanned-gage rows during drilling is different. More specifically, the vertical force on the upper fanned-gage row(s) is much less than the vertical force on the lower fanned-gage row(s).

The invention permits the borehole sidewall and corner cutting load to be distributed between the cutter elements in the fanned-gage rows such that the lowermost fanned-gage cutter elements cut the majority of the bottom portion of the borehole corner. Consequently, the fanned-gage cutter elements that are positioned farther from the borehole bottom perform progressively less borehole bottom cutting and see less vertical load from the hole bottom, while performing increased sidewall reaming duties. This configuration also allows cutter elements in the first inner row to be paired on the same cone cutter with the uppermost fanned-gage row, with the result that the first inner row cutter elements can penetrate deeper and more aggressively into the formation. This positioning also allows the first inner row cutter elements to be moved closer to the borehole sidewall, thus further protecting the fanned-gage rows from bottom hole cutting responsibilities, and enables each of the rows of cutter elements to be optimized in terms of materials, shape, and orientation so as to enhance ROP, bit durability and footage drilled at full gage.

BRIEF DESCRIPTION OF THE DRAWINGS

For an introduction to the detailed description of the preferred embodiments of the invention, reference will now be made to the accompanying drawings, wherein.

DETAILED DESCRIPTION OF THE PREFERRED EMBODIMENTS

Figure 1:
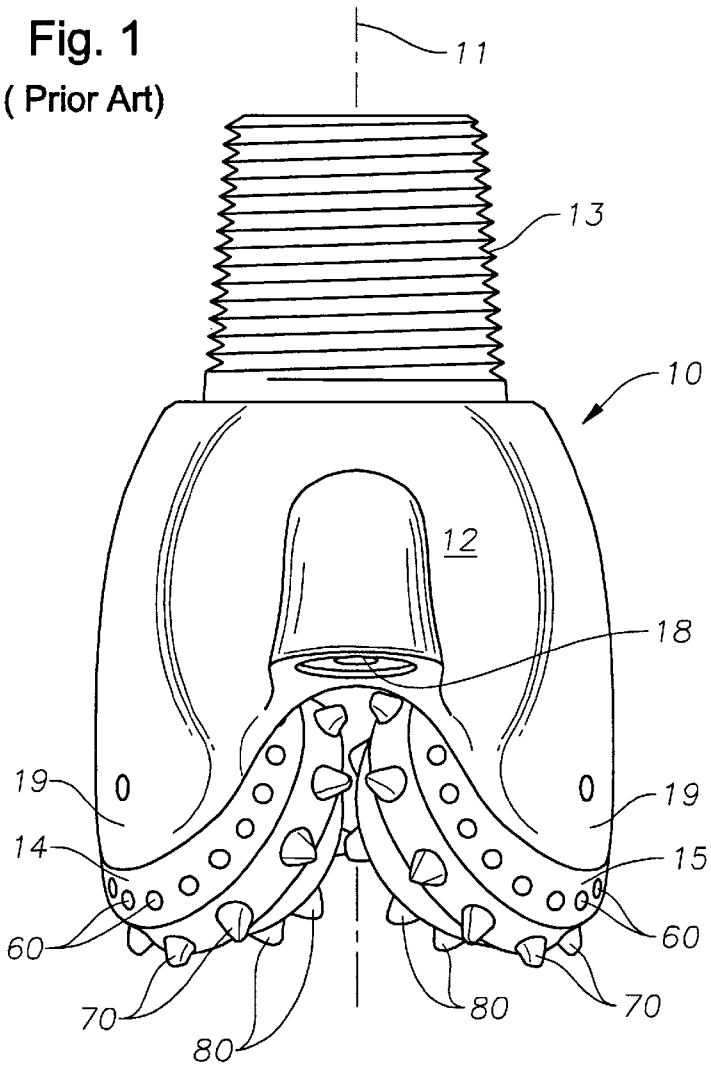
Fig. 1 ( Prior Art)
FIG. 1 is a perspective view of a typical earth-boring bit.

Referring first to FIG. 1, an earth-boring bit 10 made in accordance with the present invention includes a central axis 11 and a bit body 12 having a threaded section 13 on its upper end for securing the bit to the drill string (not shown). Bit 10 has a predetermined gage diameter as defined by three rolling cone cutters 14, 15, and 16 (not shown), which are rotatably mounted on bearing shafts that depend from the bit body 12. Bit body 12 is composed of three sections or legs 19 (two shown in FIG. 1) that form bit body 12. Bit 10 further includes a plurality of nozzles 18 that are provided for directing drilling fluid toward the bottom of the borehole and around cutters 14–16. Bit 10 may include lubricant reservoirs that supply lubricant to the bearings of each of the cutters.

Figure 2:
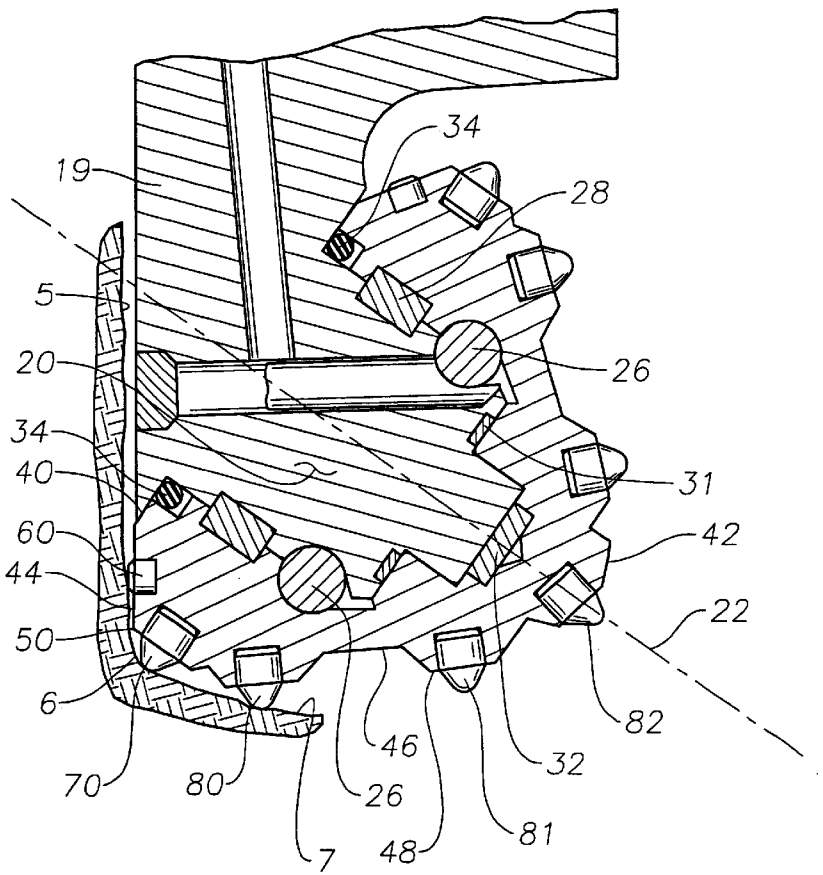
Fig. 2 (Prior Art)
FIG. 2 is a partial section view taken through one leg and one rolling cone cutter of the bit shown in FIG. 1.

Referring now to FIG. 2 in conjunction with FIG. 1, each cutter 14–16 is rotatably mounted on a pin or journal 20, with an axis of rotation 22 oriented generally downwardly and inwardly toward the center of the bit. Drilling fluid is pumped from the surface through an internal fluid passage (not shown) to nozzles 18 (FIG. 1). Each cutter 14–16 is typically secured on pin 20 by bearings, such as ball bearings 26. In the embodiment shown, radial and axial thrust are absorbed by roller bearings 28, thrust washer 31 and thrust plug 32; however, the invention is not limited to use in a roller bearing bit, and may be applied to equal advantage in a friction bearing bit. In such instances, the cones 14, 15, 16 would be mounted on pins 20 without roller bearings 28. In both roller bearing and friction bearing bits, lubricant may be supplied from a reservoir (not shown) to the bearings by apparatus that is omitted from the figures for clarity. The lubricant is sealed and drilling fluid excluded by means of an annular seal 34.

The borehole created by bit 10 includes sidewall 5, corner portion 6 and bottom 7, best shown in FIG. 2. Referring still to FIGS. 1 and 2, each cutter 14–16 includes a backface 40 and nose portion 42 spaced apart from backface 40. Cutters 14–16 each further include a generally frustoconical surface 44 that is adapted to retain cutter elements that scrape or ream the sidewalls of the borehole as cutters 14–16 rotate about the borehole bottom. Frustoconical surface 44 will be referred to herein as the "heel" surface of cutters 14–16, it being understood, however, that the same surface may be sometimes referred to by others in the art as the "gage" surface of a rolling cone cutter.

A generally conical surface 46 extends between heel surface 44 and nose 42 and is adapted for supporting cutter elements that gouge or crush the borehole bottom 7 as the cone cutters rotate about the borehole. Conical surface 46 typically includes a plurality of generally frustoconical segments 48 generally referred to as "lands," which are employed to support and secure the cutter elements as described in more detail below. Grooves may be formed in cone surface 46 between adjacent lands 48. Frustoconical heel surface 44 and conical surface 46 converge in a circumferential edge or shoulder 50. Although referred to herein as an "edge" or "shoulder," it should be understood that shoulder 50 may be contoured, such as with a radius, to various degrees, such that shoulder 50 will define a contoured zone of convergence between frustoconical heel surface 44 and the conical surface 46.

As shown in FIGS. 1 and 2, each cutter 14–16 includes a plurality of wear resistant inserts 60, 70, 80. These inserts include generally cylindrical base portions that are secured by interference fit into mating sockets drilled into the lands of the cone cutter, and cutting portions connected to the base portions having cutting surfaces that extend from cone surfaces 44, 46 for cutting formation material. The present invention will be understood with reference to one such cutter 14, cones 15, 16 being generally similarly configured.

Figure 3:
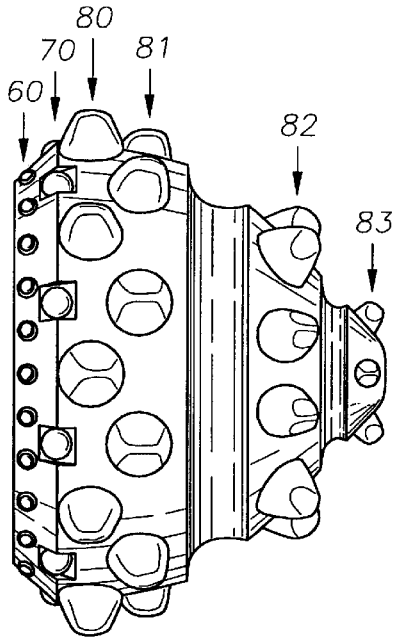
FIG. 3 is a plan view of one cone cutter of the bit of FIG. 1.

As best shown in FIGS. 2 and 3, cone cutter 14 includes a plurality of heel row inserts 60, which are secured in a circumferential row in the frustoconical heel surface 44, and a plurality of inner row inserts 80, 81, 82, which are secured to cone surface 46 and arranged in spaced-apart inner rows. As understood by those skilled in this art, heel inserts 60 generally function to scrape or ream the borehole sidewall 5 to maintain the borehole at full gage and prevent erosion and abrasion of heel surface 44. Cutter elements 80, 81, and 82 are employed primarily to gouge and remove formation material from the borehole bottom 7. The inner rows on each cone are arranged and spaced so as not to interfere with the inner rows on the other cones. It is known in the art to provide inserts 70 so as to form a row between heel row inserts 60 and the first inner row of inserts 80. These inserts 70 are sometimes referred to as gage cutting inserts. In prior bits, gage cutting inserts 70 were designed to cut the corner 6 of the borehole which includes both sidewall and borehole bottom cutting responsibilities.

As understood by those skilled in the art of designing bits, a "gage curve" is commonly employed as a design tool to ensure that a bit made in accordance to a particular design will cut the specified hole diameter. The gage curve is a standard mathematical formulation which, based upon the parameters of bit diameter, journal angle, and journal offset, takes all the points that will cut the specified hole size, as located in three dimensional space, and projects these points into a two dimensional plane which contains the journal centerline and is parallel to the bit axis. The use of the gage curve greatly simplifies the bit design process as it allows the gage-cutting elements to be accurately located in two dimensional space, which is easier to visualize. The gage curve, however, should not be confused with the cutting path of any individual cutting element. A portion of a gage curve 90 is depicted in FIG. 4.

It has been discovered that conventional bits, in an effort to maintain a full gage borehole, provide redundant bottom hole cutting support at the borehole corner. In keeping with this discovery, the present invention reduces the number of redundant gage-cutting cutter elements cutting the bottom portion of the borehole corner while maintaining (or increasing) the number of cutter elements available to cut the borehole sidewall and thus better maintain a full gage borehole. This design improvement is accomplished by positioning at least one row of gage-cutting cutter elements farther away from the borehole bottom on at least one, and preferably two, of the cones. Hence, instead of the redundant placement of gage-cutting cutter elements on each cone which contact the gage curve at the same location, according to a preferred embodiment of the present invention, each rolling cone cutter 14, 15, 16 includes a circumferential row of fanned-gage cutter elements 73, 71, 72, respectively, secured in locations along or near the circumferential shoulder 50, as shown in FIGS. 4 and 5. The rows of gage-cutting cutter elements 71, 72, 73 are preferably "fanned" along the gage curve, with the result that each of the fanned-gage cutter elements 71, 72, 73 on each cone is mounted at a distinct position along the gage curve, as described below. It is preferred that the lowest row of gage-cutting cutter elements 71 (i.e., the row closest to the borehole bottom) be formed by cutter elements on only one cone.

Figure 4:
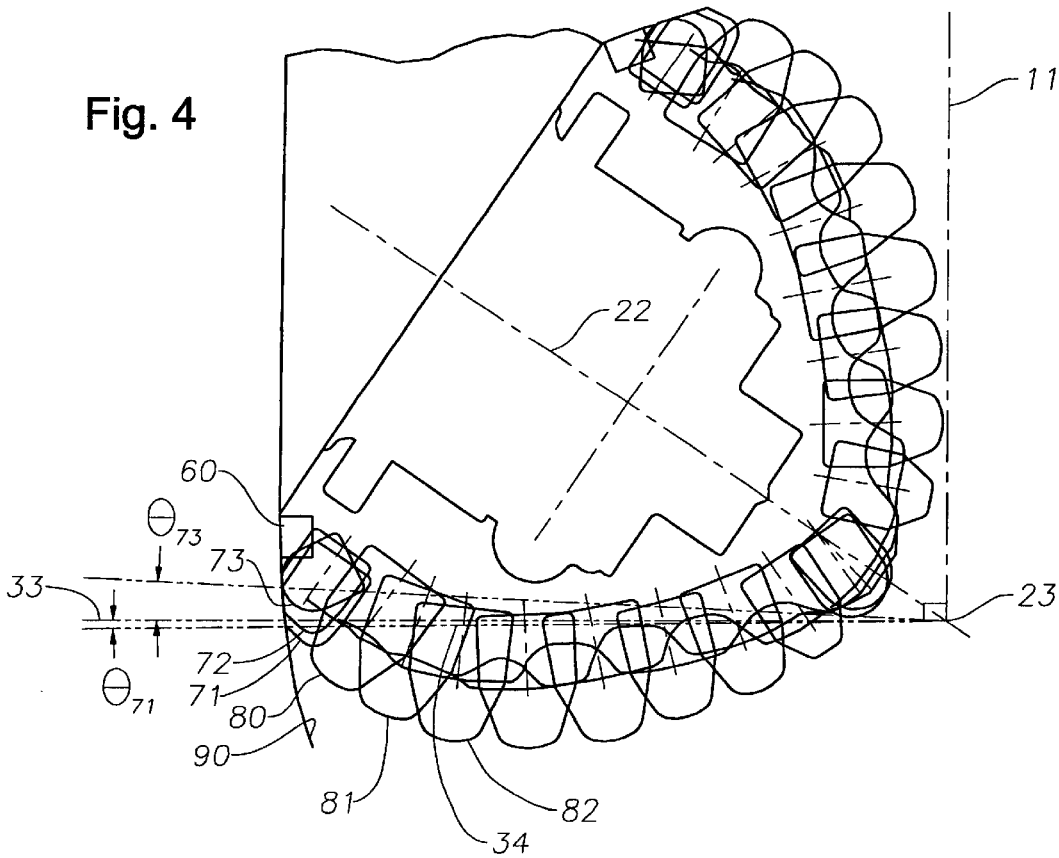
FIG. 4 is a partial cross sectional view of a set of rolling cone cutters constructed in accordance with the present invention and the cutter elements attached thereto (shown in rotated profile)
Figure 5:
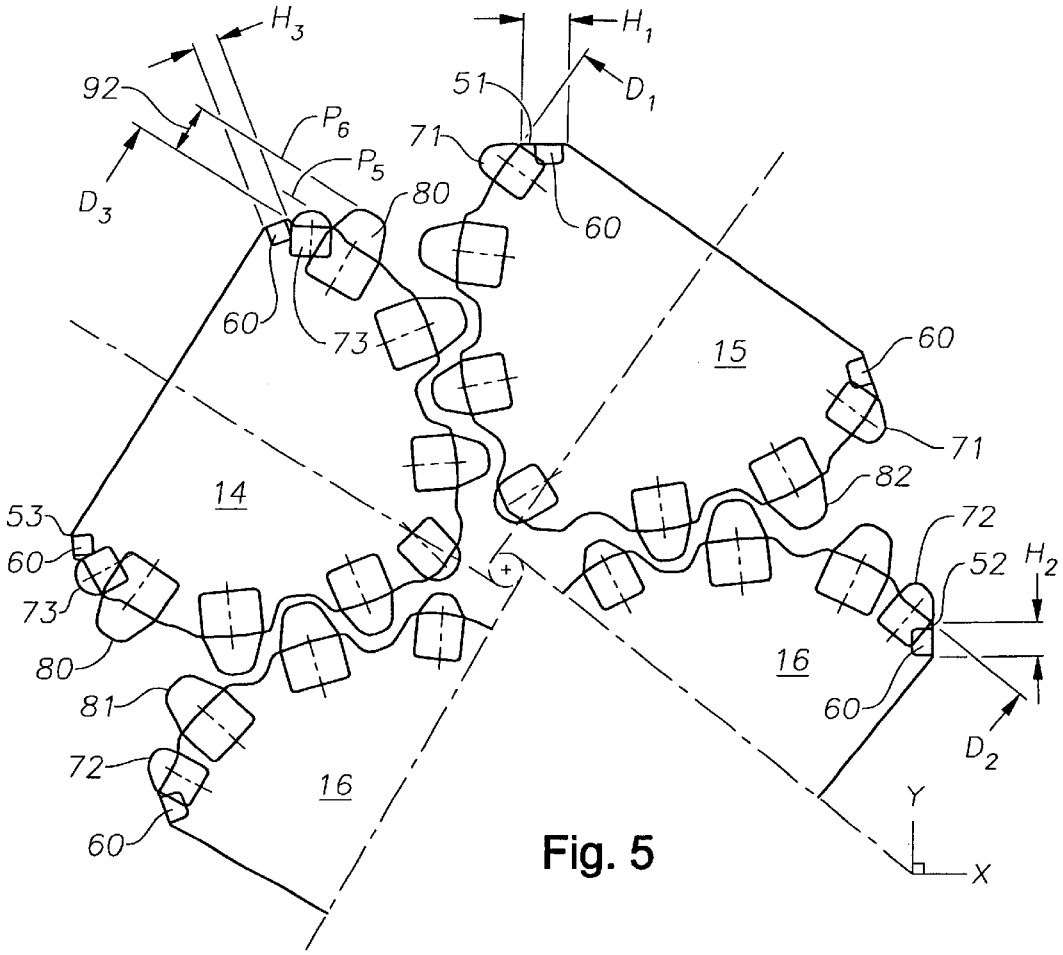
FIG. 5 is a view of a portion of the rolling cone cutters of FIG. 4, showing the placement of the cutter elements on each cone separately.

FIG. 4 shows a preferred configuration for fanned-gage inserts 71, 72, 73. In FIG. 4, the cutting profiles of inserts 60, 71, 72, 73, and 80 are viewed in rotated profile, that is, with the cutting profiles of the cutter elements shown rotated into a single plane. It can be seen that fanned-gage inserts 71, 72, 73 are positioned such that each of their cutting surfaces cuts to fall gage and that each is strategically located at a distinct position along the gage curve. As a result of this positioning, the borehole bottom cutting responsibility of each row of fanned-gage cutter elements is progressively reduced as its gage curve contact point is positioned farther from the hole bottom. This configuration also transfers a greater amount of cutting force to the adjacent inner rows, as described below, thereby increasing the cutting efficiency of these inner rows and improving the ROP potential of the bit.

Depending on the nomenclature and embodiment selected, bits constructed in accordance with the present invention can be described as having three separate rows of gage cutters. It is recognized that some naming schemes would identify only the lowest of the three rows as a gage row, and would identify the upper two rows as heel rows. In the present invention, however, all three rows of the cutter elements 71, 72, 73 perform some bottom hole cutting, rather than the strictly wall-shearing action that is typically performed by heel rows.

In addition, the present fanned-gage cutter elements may be referred to as primary cutting structures, in that they work in unison or concert to simultaneously cut the borehole, with cutter elements 71, 72, 73 each engaging the formation material and performing their intended cutting function immediately upon the initiation of drilling by bit 10. Cutter elements 71, 72, 73, are distinguishable from what are sometimes referred to as "secondary" cutting structures, which engage formation material only after other cutter elements have become worn.

As shown in FIG. 4, the gage rows of the cones of the present invention are constructed so as to have different oversize angles. As is known in the art, the term "oversize angle" is a measure of the placement of a cutting surface on a cone with respect to the true conical surface of the cone. The angle is determined by drawing a line 33 perpendicular to the longitudinal axis 11 of the bit from the point 23 where the bit axis 11 intersects the cone axis 22. The oversize angle $\theta$ is computed by measuring the angle between line 33 and a line from point 23 through the lowermost point of any cutting element that would touch the side of the borehole if that cutting element were cutting to gage. For example, the oversize angles for the rows of fanned-gage cutter elements 71 and 73 ($\theta_{71}$ and $\theta_{73}$, respectively) are shown in FIG. 4. Note that, by definition, oversize angle $\theta_{71}$ is a positive value and that $\theta_{73}$ is a negative value. According to one embodiment of the present invention, the difference between the oversize angles defined by the fanned-gage cutter elements of any two rolling cone cutters is at least 0.5 degrees and is preferably greater than or equal to 1.0 degrees. In another preferred embodiment, the difference between the oversize angles defined by the lowermost row of fanned-gage cutter elements (e.g. $\theta_{71}$) and the uppermost row of fanned-gage cutter elements (e.g. $\theta_{73}$) on the bit is at least 1.0 degrees and preferably at least 2.0 degrees and even more preferably greater than or equal to 3.0 degrees.

Describing the preferred embodiment in different terms and referring particularly to FIG. 5, it can be said that the present bit has a distinct row of gage cutting cutter elements on each rolling cone cutter. That is, each cone supports a row of primary cutter elements that contact the gage curve at a different point. Thus, for example, as shown in FIG. 5, lowermost fanned-gage cutter elements 71 are on rolling cone cutter 15, middle fanned-gage cutter elements 72 are on rolling cone cutter 16, and uppermost fanned-gage cutter elements 73 are on rolling cone cutter 14. Correspondingly, the outermost row (relative to the bit axis) of inner row inserts 80 are on the same cone, 14, as the uppermost fanned-gage inserts 73. In addition, the innermost inner row inserts 82 are on the same cone 15 as the lowermost fanned-gage inserts 71. In a preferred embodiment, the uppermost fanned-gage row 73 has the lowest insert count of the three fanned-gage rows and the lowermost fanned-gage row 71 has the highest insert count.

It has been discovered that it is possible to place the rows of gage cutter elements at different positions along the gage curve in accordance with present invention without causing bit whirl or off-center rotation. At the same time, it has been discovered that, by distributing the rows of gage-cutting elements along the borehole wall in the present manner, the inner row cutter elements can be made to more aggressively attack the borehole bottom. In a bit with a conventional gage cutter configuration, the cone supporting the outermost row of inner row inserts typically experiences the greatest vertical load during cutting. By configuring the gage cutters in the manner described herein, the vertical loads can be better balanced between the cones.

Because the cutting functions of cutter elements 71, 72, 73 and the cutter elements in the inner rows have been substantially separated, it is generally desirable that the inner row cutter elements 80 radially extend farther from cone 14 than fanned-gage cutter elements 71, 72, 73 (relative to cone axis 22) as shown in FIG. 4. Accordingly, the difference between the radial extensions of the first inner row cutter elements, e.g. 80, and the gage cutting element on the same cone, which is preferably the uppermost row of fanned-gage cutter elements 73, is referred to as the "step distance" 92; the step distance being the distance between planes $P_5$ and $P_6$ measured perpendicularly to cone axis 22 as shown in FIG. 5. Plane $P_5$ is a plane that is parallel to cone axis 22 and that intersects the radially outermost point on the cutting surface of cutter element 73. Plane $P_6$ is a plane that is parallel to cone axis 22 and that intersects the radially outermost point on the cutting surface of cutter element 80.

Figure 5A:
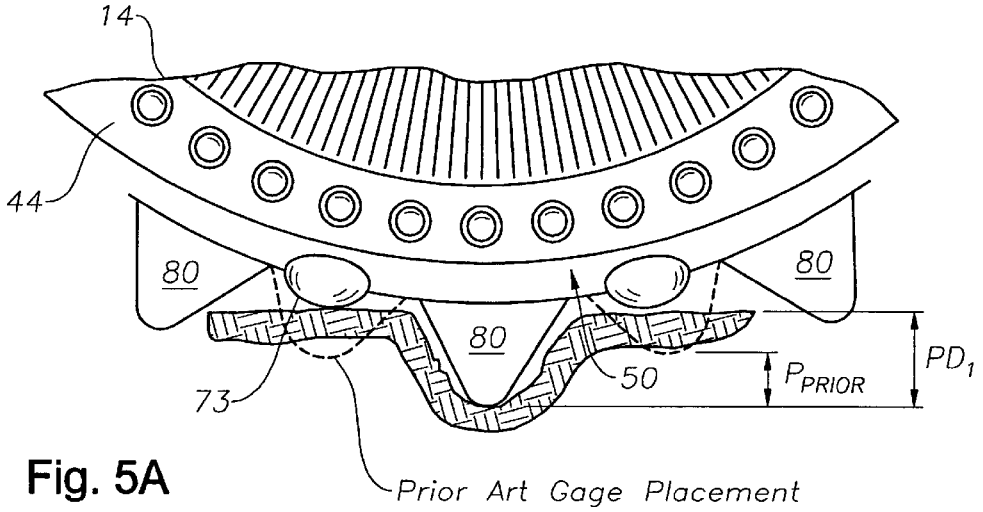
FIG. 5A is an enlarged view of a portion of a cone of FIG. 4, showing its interaction with the formation.

According to one preferred embodiment, the difference between the radial distance of $P_6$ from the cone axis and the radial distance of $P_5$ from the cone axis, i.e. the step distance for that cone, is proportional to the extension of said inner row cutter elements. As used herein, cutting element "extension" is defined as the maximum distance a given cutting element protrudes above the cone surface, as measured along the axis of the cutting element. The ratio of the step distance to the extension of the first inner row cutting element is preferably at least 0.3. More preferably, this ratio is at least 0.5. This step distance applies to both TCI bits and steel tooth bits (discussed below). This large step distance allows the first inner row cutting element to attack the formation more aggressively, as its depth of penetration, as shown in FIG. 5A, is not limited by the adjacent gage row cutting element. This is in contrast to prior art bit designs, where the step distance $P_{PRIOR}$ is relatively small and the depth of penetration of the first inner row cutter elements is limited by depth of penetration of the adjacent gage row cutter elements. This is especially beneficial in bits designated to drill in soft through some medium hard formations, such as in steel tooth bits or in TCI insert bits having IADC formation classifications between 41–62. A similar benefit, although to a lesser degree, can also be achieved for second inner row 81, based on its step distance relationship with middle fanned-gage row 72.

Still referring to FIG. 5, it can been seen that each cone has a heel land 51, 52, 53 that corresponds generally to the shoulder 50 described above. According to a preferred embodiment, the widths of heel lands 51, 52, and 53, indicated in FIG. 5 as $H_1$, $H_2$, and $H_3$, respectively, are all different from each other. More specifically, the widest heel land $H_1$ is located on the cone with the lowermost fanned-gage cutter elements 71, the intermediate heel land $H_2$ is on cone 16 with middle fanned-gage cutter elements 72, and shortest heel land $H_3$ is on cone 14 with uppermost fanned-gage cutter elements 73.

Similarly, as shown in FIG. 5, each of the three cones 15, 16, 14 has a distinct cone diameter $D_1$, $D_2$, $D_3$ respectively. $D_1$, $D_2$ and $D_3$ as used herein are defined as the diameter of the cone measured at circumferential shoulder 50.

The IADC codes used above refer to the classification system established by the International Association of Drilling Contractors for identifying bits that are suited for particular formations. According to this system, each bit receives a particular three digit IADC classification, in which the first two digits of the classification represent, respectively, "series" and formation "type." A "series" designation of the numbers 1 through 3 designates steel tooth bits, while a "series" designation of 4 through 8 refers to tungsten carbide insert bits. According to the present classification system, each series 4 through 8 is further divided into four "types," designated as 1 through 4. TCI bits are currently being designed for use in significantly softer formations than when the current IADC classification system was established. Thus, as used herein, an IADC classification range of between "41–62" should be understood to mean bits having an IADC classification within the range defined as series 4 (types 1–4), series 5 (types 1–4) or series 6 (type 1 or type 2), or within any later adopted IADC classification that describes TCI bits that are intended for use in formations softer than those for which bits of current series 6 (type 1 or 2) are intended.

In prior art bits, the gage rows on each cone are located such that they contact the gage curve at the same location. This redundant gage placement represents a design compromise that must be reached in order to achieve a balance between improved rate of penetration and greater cutting structure durability. For example, in a prior art bit design, if each row of gage cutting elements were located in the lowermost position 71, the gage row would be best positioned to protect the first inner row from substantial sidewall cutting responsibilities, thereby improving the durability of the first inner row. However, the step distance between the gage row and the first inner row would be minimal, with the result that the bit's overall ROP potential might be reduced. Also, the gage rows' relatively large oversize angle in this lowermost position results in increased scraping action against the borehole sidewall. This increased scraping can lead to increased wear rates on the gage cutting elements or, alternatively, to further compromises in the shape and/or material composition of the gage cutting elements. By further example, if the gage rows of a prior art bit were all located in the uppermost position 73, the gage rows would be best positioned to allow for increased ROP, by virtue of the relatively large step distance to the first inner row, and the low oversize angle would reduce the sidewall scraping action required. Correspondingly, however, the first inner row would be subject to a large degree of sidewall scraping action, resulting from the complete lack of cutting support from the gage rows. This would in turn result in unacceptable wear rates or catastrophic cutting element breakage in the first inner row. Thus, in general, to achieve an acceptable balance between ROP and durability, prior art bits represent a compromise in design that can be avoided by adhering to the principles of the present invention.

The failure mode of cutter elements usually manifests itself as either breakage, wear, or mechanical or thermal fatigue. Wear and thermal fatigue are typically results of abrasion as the cutter elements act against the formation material. Breakage, including chipping of the cutter element, typically results from impact loads, although thermal and mechanical fatigue of the cutter element can also initiate breakage. Breakage of prior art gage inserts is not uncommon, because of the compromise in toughness that has to be made in order for the inserts to withstand the sidewall cutting they were required to perform. Likewise, prior art gage inserts are subject to rapid wear and thermal fatigue due to the compromise in wear resistance that must be made in order to allow the gage inserts to simultaneously withstand the impact loading typically present in bottom hole cutting.

According to the present invention, because each of the fanned-gage gage cutting elements contacts the gage curve at a different point on the gage curve, each of the fanned-gage gage cutting elements will have a different borehole wall scraping distance for a given cone rotation speed to bit rotation speed ratio.

Also corresponding to the configuration of the fanned-gage gage cutting elements, the vertical forces exerted on the different fanned-gage rows during drilling are significantly different. More specifically, the vertical force on the upper fanned-gage row(s) is much less than the vertical force on the lower fanned-gage row(s). In a preferred embodiment, the vertical force exerted on the uppermost fanned-gage cutting elements is less than about 50% of the vertical force exerted on the lowermost fanned-gage row, more preferably less than about 30%, and still more preferably it is less than about 10% of the of the vertical force exerted on the lowermost fanned-gage cutting elements during drilling.

By placing the rows of fanned-gage cutter elements at strategic locations along the gage curve in accordance to the present invention, the gage cutting element size, shape, quantity, position, orientation and material properties can be optimized such that a bit can designed without the compromises associated with prior art design practices. For example, referring to FIG. 4, since the lowermost fanned-gage cutter elements 71 are subject to the greatest degree of hole bottom cutting duty relative to cutter elements 72, 73, it is preferred that cutter elements 71 have a relatively aggressive shape, such as a chisel shape, relatively large size, and be composed of a relatively tougher, less wear resistant material than the cutter elements 72, 73, so as to enable them to withstand the rigors of the gouging and scraping action required to efficiently cut the hole bottom. The lowermost fanned-gage row is preferably oriented and positioned so as to protect the first inner row from substantial sidewall cutting duty. It is also preferred (but not necessary) to provide the lowermost fanned-gage row with the largest quantity of gage cutter elements relative to the other rolling cone cutters. In contrast, uppermost fanned-gage cutter elements 73 are positioned and oriented such that it allows the first inner row 80 to aggressively penetrate into the formation, therefore, uppermost fanned-gage cutter elements 73 are subject to minimal hole bottom cutting duty as compared to cutter elements 71, 72 and will act primarily to cut the borehole wall. Hence, it is preferred that the uppermost fanned-gage cutter elements 73 have a relatively passive shape, such as semi-round top (SRT) and be composed of a relatively more wear resistant material (such as harder carbide grade, diamond enhanced insert or other superhard materials) than the cutter elements in the other fanned-gage rows, so as to achieve improved durability and maintain a fall gage borehole. It is also preferred that the uppermost fanned gage row have a relatively small size such that number of cutter elements 73 in this row and the adjacent, staggered, first inner row 80 can be maximized.

In summary, according to the preferred embodiments of this invention, fanned-gage cutter elements 71, 72, and 73 on each cone can be the same or different shapes, the same or different sizes, the same or different materials and/or be mounted at the same or different angles with respect to the cone axis and with respect to the bit axis. For example, in one preferred embodiment, cutter elements 71 and 72 are chisel-shaped, while element 73 has a hemispherical cutting surface and its axis is inclined with respect to the orientation of the other fanned-gage rows so as to better address the borehole sidewall. Likewise, gage cutting element sizes, placement, and orientation can be varied to optimize the location and quantity of the cutter elements in the inner rows, or "step distance" can be optimized for aggressive inner row cutting while maintaining gage durability. The limit on the location of the uppermost fanned-gage cutter elements is defined by the position of the heel row, by bit size, by insert size, and by available space on the cone. Similarly, the limit on the location of the lowermost fanned-gage cutter elements is defined by these factors and by the shape of the cone itself. Positioning of the lowermost fanned-gage row may also be limited by the fact that it is preferred to provide a smooth transition from the lowermost fanned-gage row to the first inner row. It is preferred but not necessary that, on bits having three rolling cone cutters and three fanned-gage rows, the middle fanned-gage row be substantially evenly spaced between the upper and lower fanned-gage rows. The fanned gage configuration further enhances the durability of bit 10 by providing a greater total number of gage cutting elements adjacent to circumferential shoulder 50 than otherwise might be possible in prior art bits designed to drill comparable formations. By dividing the borehole cutting function between fanned-gage inserts 71, 72, 73 and inner row inserts 80, 81 etc. the present invention allows much smaller diameter cutter elements to be placed on gage than conventionally employed for a given size bit. With each insert having a smaller diameter, a greater number of inserts 71, 72, 73 can be placed around the cutter 14 to maintain gage. Because two rows of fanned-gage cutter elements 72, 73 have reduced bottom hole cutting responsibilities, the increase in number of fanned-gage inserts 71, 72, 73 will not diminish or hinder ROP, and will only enhance the bit's ability to maintain full gage. At the same time, the invention allows relatively large diameter or large extension inserts to be employed as inner row cutter elements, which is desirable for gouging and breaking up formation on the hole bottom. Consequently, in preferred embodiments of the invention, the ratio of the diameter of fanned-gage inserts 71, 72, 73 to the diameter of first inner row inserts 80 is preferably not greater than 0.75. A still more preferred ratio of these diameters, especially for the uppermost cutting elements 73, is within the range of 0.5 to 0.7.

Steel Tooth Bits

Figure 6:
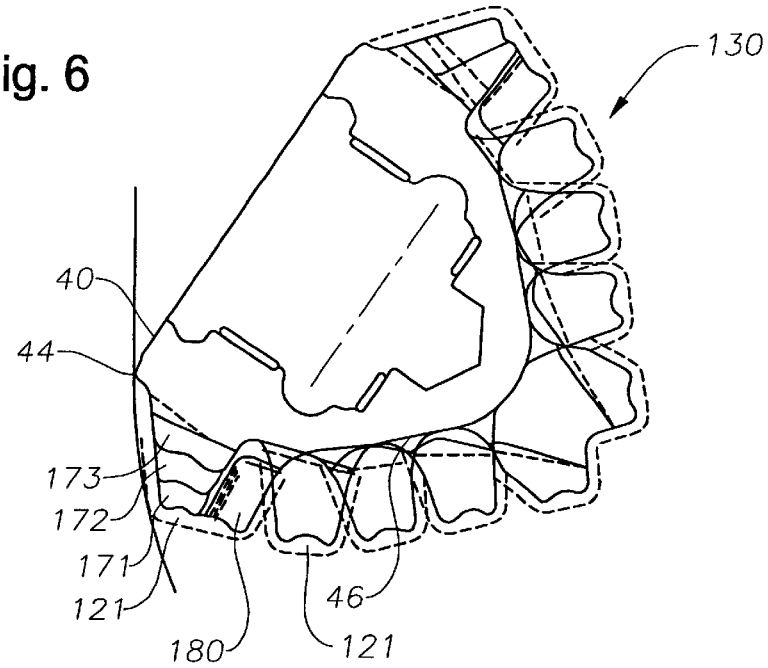
FIG. 6 is a partial cross sectional view of a set of steel toothed rolling cone cutters constructed in accordance with the present invention (shown in rotated profile)
Figure 7:
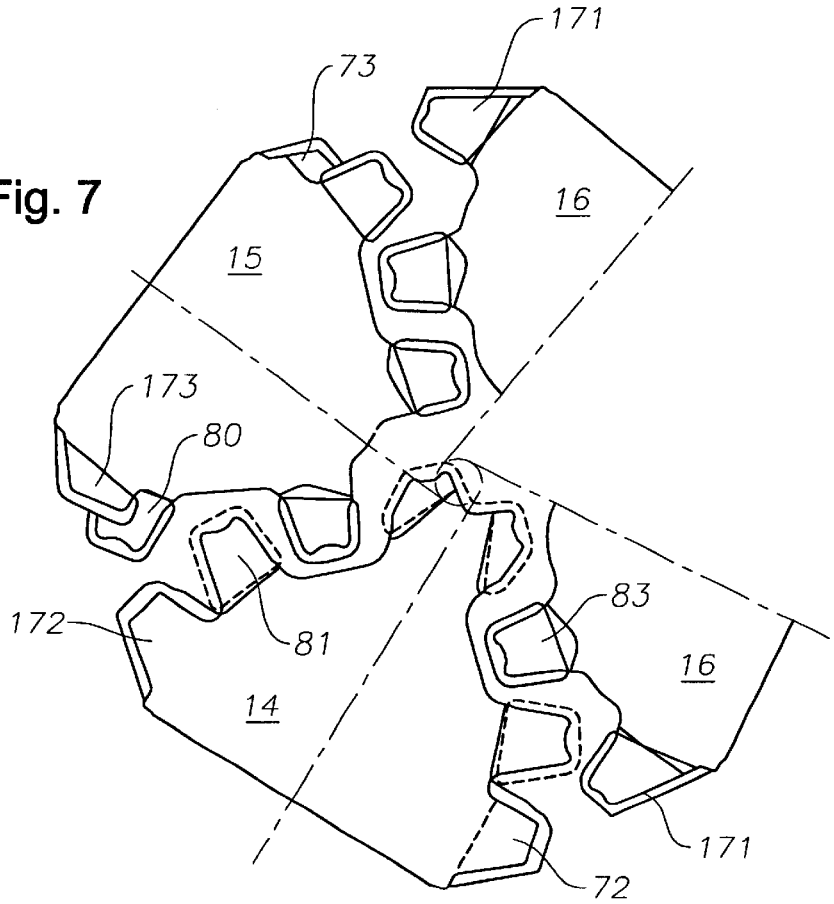
FIG. 7 is a partial cross sectional view of a set of steel toothed rolling cone cutters constructed in accordance with the present invention, showing the placement of the teeth on each cone separately.

The present invention may be employed in steel tooth bits as well as TCI bits, as will be understood with reference to FIGS. 6 and 7. As shown, a steel tooth cone 130 is adapted for attachment to a bit body 12 in a like manner as previously described with reference to cones 14–16. When the invention is employed in a steel tooth bit, the bit would include a plurality of cutters such as rolling cone cutter 130. Cutter 130 includes a backface 40, a generally conical surface 46 and a heel surface 44, which is formed between conical surface 46 and backface 40, all as previously described with reference to the TCI bit shown in FIGS. 1–4. Similarly, referring to FIG. 6, steel tooth cutter 130 includes fanned-gage cutter elements 171, 172, 173, which are formed as radially extending teeth and are disposed along the gage curve. In addition, steel tooth cutter 130 includes a plurality of first inner row cutter elements 180 generally formed as radially extending teeth. Steel teeth 171, 172, 173, and 180 preferably include an outer layer or layers of wear resistant material 121 to improve their durability.

According to certain preferred embodiments of the invention, the ratio of the step distance to the extension of the first inner row cutter element beyond the outer surface of the cone should be at least 0.3 for steel tooth bits. More preferably, this ratio should be at least 0.5. In addition, the step distance of the three fanned-gage rows should be different from each other, as shown.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. An earth-boring bit having a predetermined gage diameter an a gage curve defined by a bit diameter, journal angle, and journal offset for drilling a borehole, the bit comprising:

a bit body having a bit axis;

at least three rolling cone cutters rotatably mounted on said bit body and having a generally conical surface and an adjacent heel surface, each cone having a cone axis;

a plurality of inner row cutter elements positioned on at least one cone cutter in a first inner row;

a plurality of gage-cutting cutter elements positioned in a first fanned-gage row on a first one of said one cutters;

a plurality of gage-cutting cutter elements positioned in a second fanned-gage row on a second one of said one cutters; and a plurality of gage-cutting cutter elements positioned in a third fanned-gage row on a third one of said one cutters;

wherein the cutter elements in said first fanned-gage row, said second fanned-gage row, and said third fanned-gage row contact the gage curve at different points and said third fanned-gage row cutter elements contact the gage curve at a point above the contact points of the first and second gage-cutting rows.

2. The bit according to claim 1 wherein said cutter elements in at least one fanned-gage row have a different shape than said cutter elements in another gage-cutting row.

3. The bit according to claim 1 wherein cutter elements in said third fanned-gage row have a different shape than the cutter elements in said first and second gage-cutting rows.

4. The bit according to claim 1 wherein cutter elements in said third fanned-gage row have a semi-round top (SRT) shape.

5. The bit according to claim 1 wherein said cutter elements in at least one fanned-gage row are a different size than said cutter elements in another gage-cutting row.

6. The bit according to claim 1 wherein cutter elements in said third fanned-gage row are mounted in their cone at a different angle than the other fanned-gage rows.

7. The bit according to claim 1 wherein said cutter elements in all three fanned-gage rows are mounted in their respective cones at different angles with respect to the cone axis.

8. The bit according to claim 1 wherein said cutter elements in at least one fanned-gage row have a different cutting surface from cutter elements in another fanned-gage row.

9. The bit according to claim 1 wherein said cutter elements in at said third fanned-gage row have a different cutting surface from cutter elements in another fanned-gage row.

10. The bit according to claim 1, further including at least one inner row of cutter elements mounted on one of said cone cutters, wherein the outermost inner row cutter element is on the same cone as the uppermost cutter element in a fanned-gage row.

11. The bit according to claim 1 wherein said cutter elements in at said third fanned-gage row comprise diamond-enhanced inserts.

12. The bit according to claim 1 wherein each cutter element has an extension and wherein the extensions of the uppermost fanned-gage row cutter element and the first inner row cutter element define a step distance with respect to said cone axis, and wherein the ration of the step distance to the extension of the first inner row cutter element is greater than 0.5.

13. The bit according to claim 12, wherein said ratio is greater than 0.7.

14. The bit according to claim 1 wherein the ratio of the diameter of the uppermost fanned-gage row cutter element to the diameter of the first inner row cutter elements is preferably not greater than 0.75.

15. The bit according to claim 14 wherein the ratio of the diameter of the uppermost fanned-gage row cutter element to the diameter of the first inner row cutter elements is between 0.5 and 0.7.

16. The bit according to claim 1 wherein the lowermost fanned-gage row contains more cutter elements than any other fanned-gage row.

17. The bit according to claim 1 wherein the gage-cutting cutter elements in said first fanned-gage row are positioned on a first heel land on said first cone cutter, the gage-cutting cutter elements in said second fanned-gage row are positioned on a second heel and on said second cone cutter, the gage-cutting cutter elements in said third fanned-gage row are positioned on a third heel land on said third cone cutter and wherein said first, second, and third heel lands have different widths.

18. The bit according to claim 1 wherein the gage-cutting cutter elements in said first fanned-gage row have a first scraping distance, the gage-cutting elements in said second fanned-gage row have a second scraping distance, the gage-cutting cutter elements in said third fanned-gage row have a third scraping distance and wherein said first, second and third scraping distances are each different for a given ratio of cone speed to bit speed.

19. An earth-boring bit having a predetermined gage diameter and a gage curve defined by a bit diameter, journal angle, and journal offset for drilling a borehole, the bit comprising:

a bit body having a bit axis;

at least two rolling cone cutters rotatably mounted on said bit body and having a generally conical surface and an adjacent heel surface, each cone having a cone axis;

a plurality of inner row cutter elements positioned on one said cone cutter in a first inner row and having an inner row extension; and first and second fanned-gage rows of gage-cutting cutter elements positioned to contact the gage curve at least two different points, each cutter element having an extension, wherein the extensions of the uppermost fanned-gage row cutter element and the first inner row cutter element define a step distance with respect to said cone axis, and wherein the ratio of the step distance to the extension of the first inner row cutter element is greater than 0.5.

20. The bit according to claim 19 wherein said ratio is greater than 0.7.

21. An earth-boring bit having a predetermined gage diameter and a gage curve defined by a bit diameter, journal angle, and journal offset for drilling a borehole, the bit comprising:

a bit body having a bit axis;

at least three rolling cone cutters rotatably mounted on said bit body and having a generally conical surface and an adjacent heel surface, each cone having a cone axis;

a plurality of inner row cutter elements positioned on one said cone cutter in a first inner row and having an inner row extension; and first, second, and third fanned-gage rows of gage-cutting cutter elements positioned to contact the gage curve at least three different points, each cutter element having an extension;

wherein the extensions of the uppermost fanned-gage row cutter element and the first inner row cutter element define a step distance with respect to said cone axis, and wherein the ratio of the step distance to the extension of the first inner row cutter element is greater than 0.5.

22. An earth-boring bit having a predetermined gage diameter and a gage curve defined by a bit diameter, journal angle, and journal offset for drilling a borehole, the bit comprising:

a bit body having a bit axis;

at least two rolling cone cutters rotatably mounted on said bit body and having a generally conical surface and an adjacent heel surface;

a plurality of inner row cutter elements positioned on one said cone cutter in a first inner row; and first, second, and third fanned-gage rows of gage-cutting cutter elements positioned to contact the gage curve at different points;

wherein the fanned-gage rows are positioned to have different oversize angles.

23. The bit according to claim 22 said cutter elements in at least one fanned-gage row have a different shape than said cutter elements in another gage-cutting row.

24. The bit according to claim 22 wherein said cutter elements in at least one fanned-gage row are a different size than said cutter elements in another gage-cutting row.

25. The bit according to claim 22 wherein the difference between the oversize angles defined by the fanned-gage cutter elements of any two rolling cone cutters is at least 0.5 degrees.

26. The bit according to claim 22 wherein the difference between the oversize angles defined by the fanned-gage cutter elements of any two rolling cone cutters is at least 1.0 degrees.

27. The bit according to claim 22 wherein the oversize angle on at least one rolling cone cutter is negative.

28. An earth-boring bit having a predetermined gage diameter and a gage curve defined by a bit diameter, journal angle, and journal offset for drilling a borehole, the bit comprising:

a bit body having a bit axis;

at least two rolling cone cutters rotatably mounted on said bit body and having a generally conical surface and an adjacent heel surface;

a plurality of inner row cutter elements positioned on one said cone cutter in a first inner row; and first and second fanned-gage rows of gage-cutting cutter elements positioned to contact the gage curve at least two different points;

wherein the ratio of the diameter of the uppermost fanned-gage row cutter element to the diameter of the first inner row cutter elements is preferably not greater than 0.75.

29. The bit according to claim 28 wherein the ratio of the diameter of the uppermost fanned-gage row cutter element to the diameter of the first inner row cutter elements is between 0.5 and 0.7.

30. An earth-boring bit having a predetermined gage diameter and a gage curve defined by a bit diameter, journal angle, and journal offset for drilling a borehole, the bit comprising:

a bit body having a bit axis;

at least two rolling cone cutters rotatably mounted on said bit body and having a generally conical surface and an adjacent heel surface;

a plurality of inner row cutter elements positioned on one said cone cutter in a first inner row; and first and second fanned-gage rows of gage-cutting cutter elements positioned to contact the gage curve at least two different points;

wherein the lowermost fanned-gage row contains more cutter elements than any other fanned-gage row.

31. An earth-boring bit having a predetermined gage diameter and a gage curve defined by a bit diameter, journal angle, and journal offset for drilling a borehole, the bit comprising:

a bit body having a bit axis;

at least two rolling cone cutters rotatably mounted on said bit body and having a generally conical surface and adjacent heel surface;

a plurality of inner row cutting elements positioned on at least one cone cutter in a first inner row;

a plurality of gage-cutting cutter elements positioned in a first gage row on a first land on a first one of said cutters, said first land defining a first cone diameter; and a plurality of gage-cutting elements positioned in a second gage row on a second land on a second one of said cutters, said second land defining a second cone diameter;

wherein said first and second cone diameters are different.

32. An earth-boring bit having a predetermined gage diameter and a gage curve defined by a bit diameter, journal angle, and journal offset for drilling a borehole, the bit comprising:

a bit body having a bit axis;

at least three rolling cone cutters rotatably mounted on said bit body and having a generally conical surface and adjacent heel surface;

a plurality of inner row cutting elements positioned on at least one cone cutter in a first inner row;

a plurality of gage-cutting elements positioned in a first gage row on a first land on a first one of said cutters, said first land defining a first cone diameter;

a plurality of gage-cutting elements positioned in a second gage row on a second land on a second one of said cutters, said second land defining a second cone diameter; and a plurality of gage-cutting cutter elements positioned in a third gage row on a third land on said third cone cutter, said third land defining a third diameter;

wherein said first, second, and third cone diameters are different.

33. The bit according to claim 32, wherein said first, second, and third gage rows of gage-cutting cutter elements are positioned to contact the gage curve at different points.

34. An earth-boring bit having a predetermined gage diameter and gage curve defined by a bit diameter, journal angle, and journal offset for drilling a borehole, the bit comprising:

a bit body having a bit axis;

at least two rolling cone cutters rotatably mounted on said bit body and having a generally conical surface and adjacent heel surface;

a plurality of inner row cutting elements positioned on at least one cone cutter in a first inner row;

a plurality of heel-cutting cutter elements positioned on a first heel land on a first one of said cone cutters;

a plurality of gage-cutting cutter elements positioned in a first gage row on said first cutter;

a plurality of heel-cutting cutter elements positioned on a second heel land on a second cone cutter; and a plurality of gage-cutting elements positioned in a second gage row on a said second cutter;

wherein said first and second heel lands have different widths.

35. The bit according to claim 34, further including a third rolling cone cutter mounted on said bit body and a plurality of gage-cutting cutter elements positioned in a third gage row on a third heel land on said third cone cutters, wherein said third heel land has a different width from said first and second heel and width.

36. The bit according to claim 35 wherein said first, second, and third gage rows of gage-cutting cutter elements are positioned to contact the gage curve at different points.

37. An earth boring bit having a predetermined gage diameter and gage curve defined by a bit diameter, journal angle, and journal offset for drilling a borehole, the bit comprising:

a bit body having a bit axis;

at least three rolling cutters rotatably mounted on said bit body and having a generally conical surface and adjacent heel surface;

a plurality of inner row cutting elements positioned on at least one cone cutter in a first inner row;

a plurality of gage-cutting cutter elements positioned in a first gage row on a first one of said cutters and having a first scraping distance;

a plurality of gage-cutting cutter elements positioned in a second gage row on a second one of said cutters and having a second scraping distance; and a plurality of gage-cutting cutter elements positioned in a third gage row on a third one of said cutters and having a third scraping distance;

wherein said first, second and third scraping distances are each different for a given ratio of cone speed to bit speed.

38. The bit according to claim 37 wherein said cutter elements in at least one gage row have a different shape than said cutter elements in another gage-cutting row.

39. The bit according to claim 37 wherein said cutter elements in at least one gage row are a different size than said cutter elements in another gage-cutting row.

40. The bit according to claim 37 wherein said first, second, and third gage rows of gage-cutting cutter elements are positioned to contact the gage curve at different points.

41. An earth-boring bit having a predetermined gage diameter and gage curve defined by a bit diameter, journal angle, and journal offset for drilling a borehole, the bit comprising:

a bit body having a bit axis;

at least three rolling cone cutters rotatably mounted on said bit body and having a generally conical surface and adjacent heel surface;

a plurality of inner row cutting elements positioned on at least one cone cutter in a first inner row;

a plurality of inner row cutting elements positioned on at least one cone cutter in a second inner row, said second inner row being closer to the bit axis than said first inner row;

a plurality of inner row cutting elements positioned on at least one cone cutter in a third inner row, said third inner row being closer to the bit axis than said second inner row; and a plurality of gage-cutting cutter elements positioned in first, second, and third fanned gage-cutting cutter element rows, said rows positioned to contact the gage curve at uppermost, intermediate and lowermost points;

wherein the lowermost fanned-gage row is positioned on the same cone cutter as the third inner row cutting elements.

42. An earth-boring bit having a predetermined gage diameter and gage curve defined by a bit diameter, journal angle, and journal offset for drilling a borehole, the bit comprising:

a bit body having a bit axis;

at least two rolling cone cutters rotatably mounted on said bit body and having a generally conical surface and adjacent heel surface, each cone having a cone axis;

a plurality of inner row cutting elements positioned on at least one cone cutter in a first inner row;

a plurality of inner row cutting elements positioned on at least one cone cutter in a second inner row; and a plurality of gage-cutting cutter elements positioned in first and second fanned gage-cutting cutter element rows positioned to contact the gage curve at different points, wherein said first and second inner rows extend radially farther from the axes of their respective cones than do the fanned gage rows.

43. The bit according to claim 42 further including a plurality of inner row cutting elements positioned on at least one cone cutter in a third inner row, said third inner row extending radially farther from the axis of its cone than the fanned gage rows.

44. The bit according to claim 42 further including a plurality of inner row cutting elements positioned on at least one cone cutter in a third inner row wherein said third inner row is closer to said bit axis than said first and second inner rows and extends radially farther from said cone axis than does the uppermost fanned gage row.

45. An earth-boring bit having a predetermined gage diameter and gage curve defined by a bit diameter, journal angle, and journal offset for drilling a borehole, the bit comprising:

a bit body having a bit axis;

at least two rolling cone cutters rotatably mounted on said bit body and having a generally conical surface and adjacent heel surface;

a plurality of inner row cutting elements positioned on at least one cone cutter in a first inner row;

a plurality of gage-cutting cutter elements positioned in a first fanned-gage row on a first one of said cutters; and a plurality of gage-cutting cutter elements positioned in a second fanned-gage row on a second one of said cutters, wherein the magnitude of the vertical force exerted on said first fanned gage row during drilling is less than about 50% of the magnitude of the vertical force exerted on said second fanned-gage row during drilling.

46. The bit according to claim 45 wherein the magnitude of the vertical force exerted on said first fanned gage rows during drilling is less than about 30% of the magnitude of the vertical force exerted on said second fanned-gage row during drilling.

47. The bit according to claim 45 wherein the magnitude of the vertical force exerted on said first fanned gage rows during drilling is less than about 10% of the magnitude of the vertical force exerted on said second fanned-gage row during drilling.

* * * * *